United States Patent [19]

Berger

[11] 4,026,306

[45] May 31, 1977

[54] TOBACCO SMOKE FILTER

[75] Inventor: Richard M. Berger, Richmond, Va.

[73] Assignee: American Filtrona Corporation, Richmond, Va.

[22] Filed: Nov. 6, 1975

[21] Appl. No.: 629,680

[52] U.S. Cl. ..... 131/10.5; 131/261 B

[51] Int. Cl.[2] ..... A24D 1/04

[58] Field of Search ..... 131/10.5, 10.7, 261 B, 131/261 R, 201, 202, 10 R, 10.9, 264–269

[56] References Cited

UNITED STATES PATENTS

| | | | |
|---|---|---|---|
| 3,270,750 | 9/1966 | Campbell | 131/10.7 X |
| 3,486,508 | 12/1969 | Sipos | 131/10.5 |
| 3,685,523 | 8/1972 | Labbe | 131/10.5 X |
| 3,888,160 | 6/1975 | Westcott et al. | 131/261 B X |

FOREIGN PATENTS OR APPLICATIONS

| | | | |
|---|---|---|---|
| 1,960,654 | 10/1970 | Germany | 131/10.7 |

*Primary Examiner*—John F. Pitrelli

[57] ABSTRACT

Tobacco smoke filters and methods and means for making same wherein the products have an elongated annular intermediate member overwrapped with a conventional plug wrap, with discrete inner plugs of a length shorter than the intermediate member and offering at least as much resistance to passage of smoke as the intermediate member, being secured within the intermediate member against axial displacement. The inner member may be formed of a filtration material, as is the intermediate member, or the inner member may be formed of a material which is non-permeable to smoke. Portions of the intermediate member may be crimped to embed them into the inner member thereby improving the engagement between these members. The inner member may be centrally positioned within the intermediate member to form cavities at each end of the filter or, alternatively, the inner member may be secured at one end of the intermediate member to provide only a single inner cavity. The smooth outer surface of the intermediate member enables the attachment of a conventional plug wrap without the need for an internal glue line. Means are disclosed for cutting an inner rod to form a multiplicity of inner plug members, and then axially spacing the inner members from each other by injecting jets of air or the like between adjacent inner members.

7 Claims, 10 Drawing Figures

TOBACCO SMOKE FILTER

This invention relates to the production of filter means, and relates more particularly to tobacco smoke filter elements. More specifically, the instant inventive concepts are primarily concerned with producing filter means for cigarettes, although the products of this invention are generally useful as filters, particularly for tobacco smoking means, whether they be cigarettes, cigars, pipes or the like. Since filters for cigarettes are particularly commercially important, the basic embodiments of the instant invention will be discussed as they relate to the production of filtered cigarettes.

Various prior art technqiues are known for making filters for use in connection with cigarettes and the like, although the resultant products, in general, have one or more disadvantages. Perhaps the most important property of the filter means is its efficiency, that is, its ability to remove undesirable constituents from the tobacco smoke. Filtration efficiency is ordinarily measured in terms of the percentage of total particulate material (TPM) removed from the smoke, although there is also some concern for the percentage of gas phase constituents which the filter means is capable of removing. While filtration efficiency is perhaps the most important property of cigarette filter means, other properties must also be considered, including pressure drop, taste, hardness, appearance and cost. It is necessary to produce a filter which satisfies commercial requirements in each of these areas. Frequently, a compromise of certain properties is required in order to satisfy the need for others. For example, the most commonly utilized cellulose acetate filter means has a relatively low filtration efficiency since increased efficiency can only be obtained by increasing the density of the filter material or the length of the filter element, both of which produce a pressure drop across the filter which is excessive and unacceptable from a commercial standpoint. While various suggestions have been made for the production of filter means which have improved filtering properties, most prior art developments have not been commercially acceptable either because the resulting means have been found to have objectionable "taste" characteristics whereby cigarettes provided with such filtering means fail to satisfy a large segment of the smoking public, or because the techniques and/or the materials utilized in the production of such filter means have increased the cost excessively.

High filtration efficiency is considered by the industry to be removal of 60 percent or more of total particulate matter. Cigarette filters having such properties are presently being produced in accordance with the teachings of U.S. Pats. Nos. 3,533,416, 3,599,646, 3,637,447, 3,648,711, 3,805,801 and 3,810,477, all of which are commonly assigned with the instant application. The disclosures of these prior art patents are incorporated herein in their entirety by reference.

A further development in the production of tobacco smoke filter means is disclosed in commonly assigned U.S. Pat. No. 3,811,451, the entire disclosure of which is also incorporated herein by reference.

It is always desirable, however, to provide further techniques for the production of cigarette filter elements or the like which provide high filtration with correspondingly low pressure drop, and which may be made at high speeds by eliminating certain operations of prior art techniques, thereby minimizing manufacturing costs. It is this area with which the instant invention is concerned.

Thus, it is a primary object of this invention to provide a cigarette filter means or the like and a method and means for manufacturing same wherein the products have a high filtration efficiency, satisfactory pressure drop and other commercial requirements, and wherein the method and means utilized enable high speed production of the final product.

A further object of this invention is to provide a cigarette filter having a multiplicity of embodiments which enable selective production of a product having a chosen path for passage of smoke, in some embodiments nonsmoke permeable elements being incorporated to direct the smoke, while in other embodiments, the entire filter means being produced from materials that offer filtration properties.

Another object of this invention is the provision of a method and means for forming an annular intermediate element of a smoke filtering material and for depositing axially spaced inner plug members within the internal bore of the intermediate member.

Still a further object of this invention is to provide techniques whereby the intermediate and inner members may be crimped to assist in precluding axial disengagement between these elements.

Other and further objects of this invention reside in the chemical and physical characteristics of the filter product, as well as the manipulative steps utilized in the production and the various features of construction found in the manufacturing apparatus. Still other objects will in part be obvious and in part be pointed out as the description of the invention proceeds, and as will be seen from the accompanying drawings, wherein.

Figure 9:
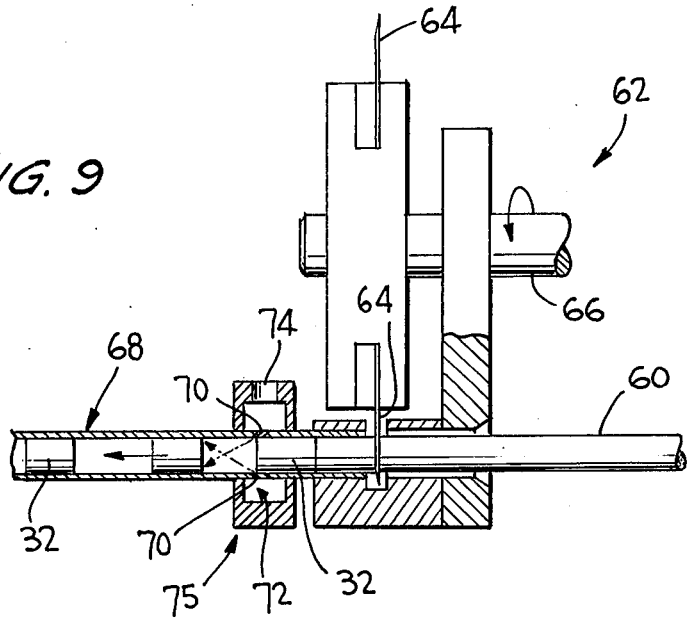
Figure 10:
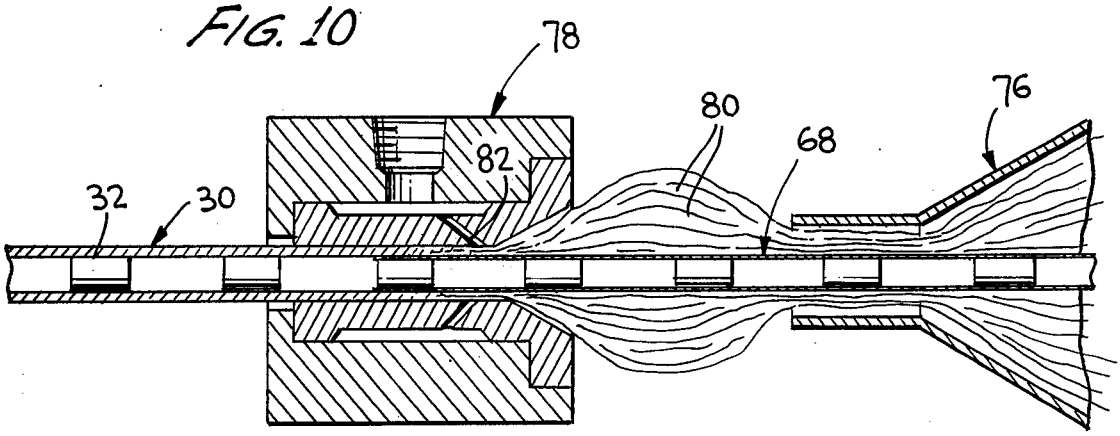

FIG. 9 is a fragmentary view, partially in cross-section for illustrative clarity, showing a means for transversely severing the inner rod to form discrete inner members, and then axially spacing the inner members from each other; and FIG. 10 is a fragmentary cross-sectional view through the portion of the manufacturing apparatus wherein the intermediate member is formed and the inner members are deposited within the axial bore of the intermediate member in axially spaced fashion.

Like reference characters refer to like parts throughout the several views of the drawings.

Figures 1, 2, 3, 4, 5, 6, 7, 8:
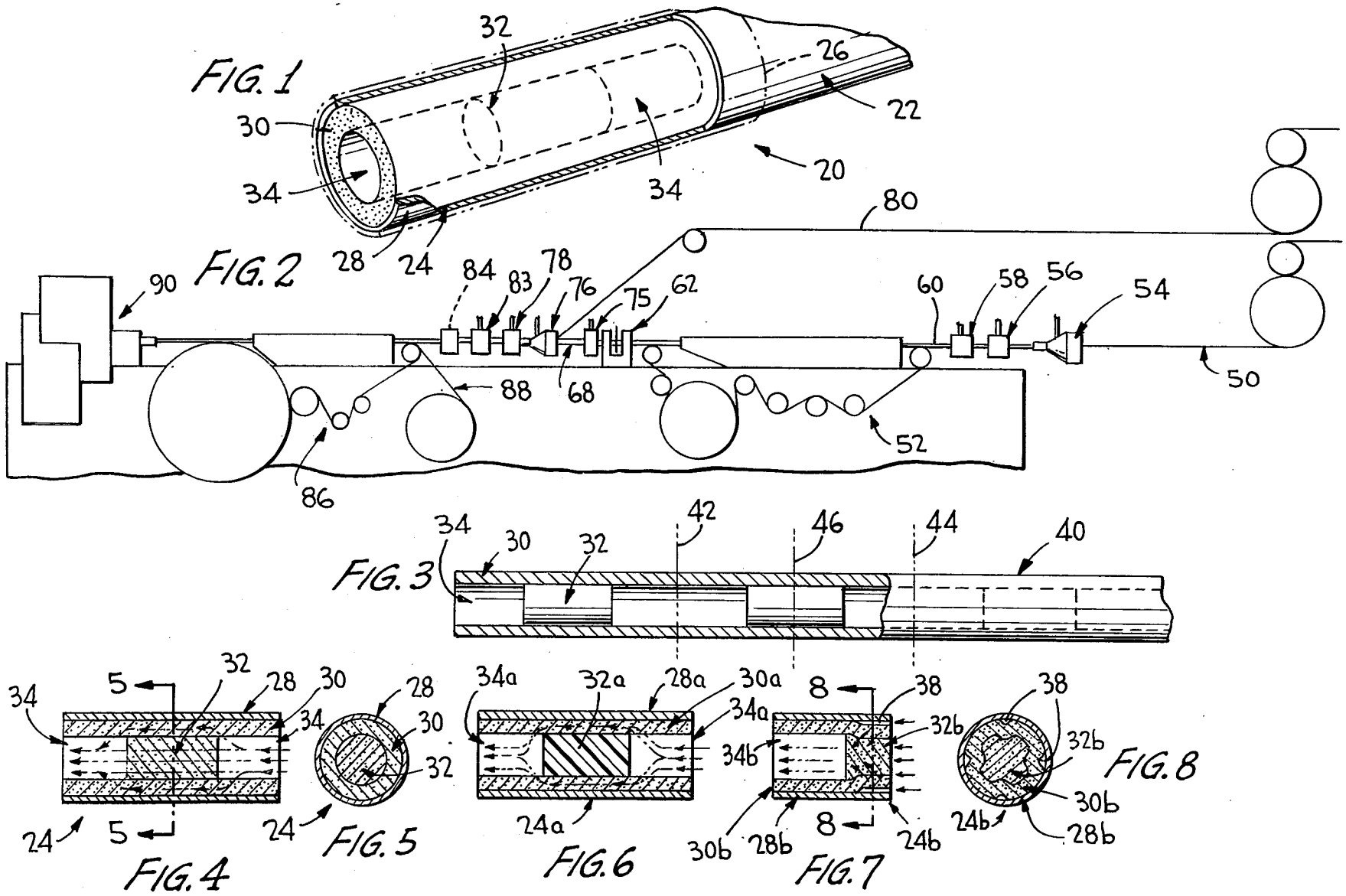
FIG. 1 is an enlarged perspective view of one form of filtered cigarette produced according to this invention, parts being broken away for illustrative clarity and convenience.
FIG. 2 is a schematic view of a method and means for making filter elements according to the instant inventive concepts.
FIG. 3 is a fragmentary view of a filter rod produced according to this invention, parts being in section and parts being broken away for illustrative clarity.
FIG. 4 is a longitudinal sectional view through the filter means of the cigarette of FIG. 1, wherein the inner member is formed of a smoke-permeable material, the paths of smoke through the filter means being shown.
FIG. 5 is a transverse sectional view taken substantially along lines 5—5 of FIG. 4.
FIG. 6 is a view similar to FIG. 4 through a modified embodiment of a filter means according to the instant inventive concepts wherein the inner member is nonpermeable to smoke, the paths of travel of smoke through a filter means of this type also being shown.
FIG. 7 is a longitudinal sectional view through still a further modified embodiment of the filter means according to the instant inventive concepts wherein the intermediate and inner members have been crimped to assist in precluding relative axial movement between these members, the paths of travel of smoke through this filter means also being shown.
FIG. 8 is a transverse cross-sectional view taken substantially along lines 8—8 of FIG. 7.

Referring now to the drawings, and more particularly to FIG. 1, a filtered cigarette according to the instant inventive concepts is designated generally by the reference numeral 20 and comprises basically a tobacco rod shown partially at 22 and a filter element according to one embodiment of this invention designated generally by the reference numeral 24, a conventional tipping overwrap being shown in dotted lines at 26 securing the tobacco rod and the filter element in end-to-end relationship according to well known prior art techniques.

Filter element 24 comprises basically an axially elongated, hollow, outer member 28 formed by conventional plug wrap as will be explained hereinafter in more detail, an axially elongated, hollow, intermediate member 30 formed of a filtering material, and an inner plug member 32 disposed within the intermediate member 30.

It will be seen that the outer member 28 and the intermediate member 30 are coextensive in axial length whereas the inner member 32 is shorter than either of the foregoing elements to define cavity means 34 within the intermediate member. In the embodiment of FIG. 1, it will be seen that the inner member 32 is spaced from both ends of the intermediate member 30 so that discrete cavities 34 are formed at each end of the filter element 24.

At least the intermediate member 30 is preferably and primarily formed from a continuous tow of cellulose acetate filamentary material, although other filtering material may be used with slight modifications. For example, filamentary tow formed of other materials such as polyethylene, polypropylene and the like, or even non-woven staple fibers of the type described in some detail in U.S. Pats. Nos. 3,297,041 and 3,552,400, also commonly assigned, the disclosures of which are incorporated herein by reference, may be used in the production of the intermediate member 30. In fact, it is even possible to produce this member from an extruded, open celled foamed material, such as cellulose acetate foam or the like. However, since cellulose acetate filamentary tow is the presently preferred material from a commercial standpoint, the remainder of this specification will be directed to the use of such material for the production of the intermediate member 30. Thus, the intermediate member 30 is preferably formed of crimped filamentary cellulose acetate members bonded together at their contact points to form smoke-permeable elements defining tortuous paths for passage of smoke therethrough. Filtering material of this nature is well known, as are techniques for producing same.

According to one embodiment of this invention, the inner member 32 is also formed of crimped filamentary cellulose acetate members bonded together at their contact point to form a smoke-permeable element defining tortuous paths for passage of smoke therethrough. An element of this nature is shown in FIGS. 4 and 5. In FIG. 4 the paths for passage of smoke through the filter element 24 are shown by dashed arrows. Thus, it will be seen that the smoke passes through both cavities 34, as well as through the material of the intermediate member 30, and the material of the inner member 32.

In FIG. 3 a continuous rod 40 made up of a multiplicity of integrally connected elements of the type shown at 24 in FIGS. 1, 4 and 5, will be seen. This rod is severed transversely along the lines 42, 44 to produce individual filter elements such as shown at 24. Of course, the rod 40 could be severed at other locations to produce filter elements of different lengths. For example, severing the rod 40 at 46 would produce filter elements which include a cavity means 34 at only one end, and only half of an inner plug member 32, one end portion of which is coincident with the end of the intermediate member 30. Moreover, the rod 40 could be severed in a manner such as to produce filter elements of multiple length. It is common practice, in fact, to initially produce double filters which are then secured to two tobacco sections by a common tipping overwrap following which individual filtered cigarettes are formed by severing the double filter at its midpoint.

Reference is now made to FIG. 6 wherein a filter element similar to the embodiment of FIGS. 1, 4 and 5 is shown, with the inner member of the embodiment of FIG. 6 being formed of a non-smoke permeable material. Since, except for the material of the inner member, the embodiment of FIG. 6 is substantially identical to that of FIGS. 1, 4 and 5, the same reference numeral has been used to designate similar parts, followed by the suffix *a*. It will be seen from the arrows in FIG. 6, that smoke passing through the filter element **24*a*, passes through the individual cavities 34*a* and the intermediate member 30*a*, but cannot pass centrally or axially of the filter element, being forced radially outwardly through the annular wall of the intermediate member 30*a*. In an embodiment of this type, the inner member 32*a* may be formed of a variety of non-smoke permeable materials. For example, an elongated rod of closed-celled polystyrene may be extruded and transversely severed at axially spaced locations to form discrete non-smoke permeable inner members. Of course, other non-smoke permeable materials may be utilized for formation of the inner members 32*a*** in an obvious manner.

Referring now, particularly, to FIGS. 7 and 8, another embodiment of the instant invention will be seen, wherein parts similar to those of previous embodiments have been designated by the same reference numeral followed by a suffix *b* to facilitate an understanding of this embodiment. Effectively, it will be seen that the filter element **24*b* shown in FIGS. 7 and 8 is half of a filter element such as shown at 24 in FIGS. 4 and 5 such as would result if the filter rod 40 were severed at 46, in addition to being severed at 42 and 44. Although the embodiment of FIGS. 7 and 8 has been shown as having a smoke-permeable inner plug member 32*b*, it is obvious that a non-smoke permeable inner member could be substituted therefor. However, with this particular embodiment the use of a smoke-permeable plug member 32*b* is desirable so as to set up smoke flow patterns of the type shown by the arrows in FIG. 7. This particular pattern results from the provision of limited crimped portions forming grooves or the like 38 which define cavity means between the outer surface of the intermediate member 30*b* and the inner surface of the outer member 28*b*. The crimping which forms the grooves 38 functions, additionally, to embed portions of the material of the intermediate member 30***b* into portions of the inner member 32*b* as will be seen from FIGS. 7 and 8, assisting in precluding relative axial movement between these members. Of course, it is important that the crimped portion of the outer surface of the intermediate member 30*b* be limited in nature so as to provide a substantially uniform outer surface for the intermediate member and, thus, a uniform support for the outer member throughout its entire length.

In the absence of crimping such as shown at 38 in the embodiment of FIGS. 7 and 8, the inner member is secured within the intermediate member and, in turn, the intermediate member is secured within the outer member, by having these elements in press-fit relationship. Thus, the intermediate member is formed over the axially spaced inner members in a manner wherein the intermediate member radially grips the inner member and, likewise, the outer member is wrapped about the intermediate member under sufficient tension to preclude axial passage of smoke between their mating surfaces and to preclude relative axial displacement between these members.

Reference is now made particularly to FIG. 2 and FIGS. 9 and 10, for an overall method and means utilized in producing filter elements in accordance with this invention. Basically, the overall technique is similar in many respects to the techniques shown and described in detail in U.S. Pat. No. 3,637,447, referred to previously. According to an embodiment of this invention wherein the inner member is formed from a filtering material such as cellulose acetate tow, a source of such filtering material is shown schematically at 50. The filtering material 50 includes a multiplicity of bondable fibrous members activated by contact with a hot fluid, such as steam. Thus, the filtering material 50 is continuously passed into and through a conventional stuffer jet 54 and pulled by garniture means 52 through steam head 56 and cooling head 58 to produce a smoke-permeable rod 60 which is relatively self-supporting.

The rod 60 is transversely severed at axially spaced locations to form discrete inner plug members 32 by a cutting means 62, details of one form of which are shown particularly in FIG. 9. The cutting means 62 includes a plurality of radially, circumferentially spaced blades 64 which are rotatably supported as at 66 to transversely sever the rod 60.

The uncut portion of the rod 60, continuously moved by the garniture means 52, pushes the discrete inner plug members 32 into an elongated tube 68 which is so dimensioned as to peripherally seal the discrete inner plug members 32 as they slide through its internal bore. As will be seen particularly in FIG. 9, a multiplicity of passageways 70 extending radially and angled forwardly in the direction of travel of the plug members 32, are provided in the tube 68 at a location wherein they communicate with a manifold 72 connected through a conduit 74 to a source of fluid pressure, such as pressurized air or the like, in a spacing means 75. These jets of pressurized fluid, shown as dotted arrows in FIG. 9, are injected between adjacent plug members 32 so as to axially separate them while they are pushed through the tube 68.

Of course, other techniques and materials may be used for the production of the inner rod and for transversely severing such rod and axially spacing the resultant inner members, but the device shown in FIG. 9 has been found to function satisfactorily.

With an arrangement of the foregoing type, the elongated tube 68 may be simultaneously utilized to provide a mandrel extending through a further stuffer jet 76 and into a further steam head 78 to form an annular space for production of the intermediate member 30 from a further filamentary tow material such as shown at 80. Of course, with such an arrangement, the tube 68 must extend into the steam head 78 past the points 82 at which steam contacts the filamentary tow 80 to form the annular intermediate member 30. As will be seen in FIG. 10, the inner members 32 are then deposited, in axially spaced relationship, into the internal bore of the intermediate member 30 to form the spaced cavity means 34.

Due to the resilient nature of the material utilized in the formation of the inner and intermediate members, and the use of a relatively thin walled tube 68, the inner and intermediate members 32, 30 will normally be in press-fit contact to preclude relative axial movement between these members. However, if desired, following passage of the composite formed of the intermediate and inner members through a cooling head such as shown at 83, drimping wheels or the like, such as shown in detail in FIGS. 10–13 of U.S. Pat. No. 3,637,447, and designated schematically by the dashed lines at 84 in FIG. 2, may be utilized for forming limited external cavities such as shown at 38 in FIGS. 7 and 8, and for embedding a portion of the intermediate member in the outer surface of the inner member.

In either event, the composite rod is continuously moved forwardly by a further garniture means 86 in which it is overwrapped by a conventional plug wrap, a source of which is shown at 88, to form the outer member 28, and then severed transversely at selected locations in a cutting means such as shown schematically at 90.

Due to the substantially uniform and smooth outer surface of the intermediate member 30, it will be seen that the outer member 28 is uniformly supported throughout its entire length. This avoids the need for an internal glue line to secure the outer member in position as has been necessary with certain prior art techniques.

Moreover, since the intermediate member is either uncrimped or only slightly crimped to form relatively limited external cavities such as shown at 38 in FIGS. 7 and 8, it is not distorted as results from substantial crimping techniques utilized according to the prior art. When the inner rod is substantially crimped, and thus distorted, it is necessary to use a relatively heavy weight overwrap to form the outer member in order to return the filtering material to a true cylindrical shape. Since the techniques of this invention avoid the need for any substantial crimping, a relatively light weight conventional plug wrap may be used in producing the outer member, minimizing production costs in an obvious manner.

The following data compares certain characteristics of products made according to this invention with prior art products. The type designated as I is a plug made according to this invention wherein the inner member is formed of a cellulose acetate tow. The type designated as II is a filter element according to this invention wherein the inner member is formed of a non-smoke permeable polystyrene plug. The type designated as III is a single filter element of the type shown, for example, in U.S. Pat. No. 3,637,447 and the type designated as IV is a double filter such as shown in U.S. Pat. No. 3,805,801.

| Type | Weight | Pressure Drop | Percent Retention |
|---|---|---|---|
| I | 12.1 gms | 2.4" | 69 |
| II | 16.1 gms | 1.0" | 78 |
| III | 16.5 gms | 2.8" | 69 |
| IV | 13.4 gms | 2.8" | 65 |

It will be seen from the above that filter elements prepared according to the instant inventive concepts compare favorably with the prior art filters, while providing at least as good, and frequently better, filtration efficiency. Other commercially significant properties such as hardness, taste and the like also compared favorably with prior art filter elements. Moreover, manufacturing techniques for the products of this invention require less expensive conventional plug wrap and are especially high speed.

It will now be seen that there is herein provided a smoke filter, and method and means for manufacturing same, which satisfies the various objectives set forth previously, and which provide significant advantages of a commercial nature. While this invention has been described with reference to presently preferred exemplary embodiments thereof, it should be clearly understood that the invention is not limited thereto, but may be variously practiced within the scope of the following claims.

The embodiments of the invention in which an exclusive property or privilege is claimed are defined as follows:

1. A smoke filter means including a filter element comprising:

a. an axially elongated, hollow, outer member;

b. an axially elongated, hollow, intermediate member disposed within said outer member;

c. an inner member disposed within said intermediate member;

d. said outer member including an inner surface and having spaced end portions;

e. said intermediate member comprising a filtering material and including an inner surface and an outer surface and having spaced end portions;

f. said inner member comprising a filtering material and including an outer surface and having spaced end portions;

g. said outer surface of said intermediate member being juxtaposed to said inner surface of said outer member substantially throughout their extent to at least substantially preclude axial passage of smoke across the area therebetween, and said outer surface of said inner member being juxtaposed to said inner surface of said intermediate member throughout the extent of said outer surface of said inner member to at least substantially preclude axial passage of smoke across the area therebetween while permitting transverse passage of smoke between said intermediate and inner members;

h. said intermediate member and said outer member being coextensive in axial length and said inner member being shorter than said intermediate member to define inner cavity means within said intermediate member;

i. said inner member being discrete from said intermediate member and being securely held by said intermediate member against axial movement relative thereto;

j. said intermediate member being discrete from said outer member and being securely held by said outer member against axial movement relative thereto;

k. said inner member offering approximately the same resistance to passage of smoke as said intermediate member; and l. limited longitudinally extending, circumferentially spaced, outer cavity means defined in the outer surface of said intermediate member, said outer cavity means being of a length substantially no greater than the length of said inner member and corresponding portions of said intermediate member being embedded in said inner member to fixedly secure these members to each other;

whereby smoke passing through said filter element must travel through said inner cavity means and at least one of said inner and intermediate members.

2. A cigarette comprising, in combination, a tobacco rod and a filter means secured in end-to-end relationship to one end of said tobacco rod, said filter means including a filter element as defined in claim 1.

3. A filter rod comprising a multiplicity of filter elements as defined in claim 1 integrally connected together.

4. A filter means according to claim 1 wherein said end portions of said inner member are each spaced from their respective end portions of said intermediate member to define discrete inner cavities within said intermediate member at each end of said inner member.

5. A filter means according to claim 1 wherein one end portion of said inner member is coincident with one end portion of said intermediate member to define a single inner cavity within said intermediate member.

6. A filter means according to claim 1 wherein said filtering material of said inner and intermediate members each comprise a multiplicity of crimped fibrous elements bonded together at their points of contact to define smoke-permeable members each providing a tortuous path for the passage of smoke therethrough.

7. A filter means according to claim 6 wherein said filtering materials each comprise cellulose acetate tow.

* * * * *